US008813836B2

(12) United States Patent
Kajaria et al.

(10) Patent No.: US 8,813,836 B2
(45) Date of Patent: Aug. 26, 2014

(54) UNI-BORE DUMP LINE FOR FRACTURING MANIFOLD

(75) Inventors: Saurabh Kajaria, Houston, TX (US); Kendall Keene, Houston, TX (US)

(73) Assignee: T-3 Property Holdings, Inc., Houston, TX (US)

( * ) Notice: Subject to any disclaimer, the term of this patent is extended or adjusted under 35 U.S.C. 154(b) by 699 days.

(21) Appl. No.: 13/006,276

(22) Filed: Jan. 13, 2011

(65) Prior Publication Data

US 2012/0181015 A1 Jul. 19, 2012

(51) Int. Cl.
*E21B 33/03* (2006.01)
*E21B 33/038* (2006.01)

(52) U.S. Cl.
USPC ..... 166/75.15; 166/90.1; 166/308.1

(58) Field of Classification Search
USPC ..... 166/177.5, 271, 308.1, 75.11, 75.13, 166/75.15, 54.1, 90.1, 95.1, 97.1, 306, 313
See application file for complete search history.

(56) References Cited

U.S. PATENT DOCUMENTS 4,901,563 A 2/1990 Pearson
6,698,915 B2 3/2004 Dearing et al.
2007/0012451 A1* 1/2007 O'Neill ..... 166/367

OTHER PUBLICATIONS

Demong, K. and Keene, K., "Shale Energy: Developing The Horn River", World Oil Online, vol. 231, No. 10, [retrieved from the Internet on Jan. 13, 2011 using <URL: http://www.worldoil.com/SHALE-ENERGY-Developing-the-Horn_River-Independents-and-IOCs-active-in-Horn-River-Basin-october-2010.html>].

* cited by examiner

*Primary Examiner* — Brad Harcourt
(74) *Attorney, Agent, or Firm* — Locke Lord LLP

(57) ABSTRACT

The disclosure provides one or more manifolds having manifold portions primarily of fluid conduit and flow components mounted to the manifold portions, such as valves and fluid fittings. The manifold is formed with a uniform bore, so that the manifold portions are the same size along the flow path of the manifold, and the valves and fluid fittings have a bore the same size of the bore of the manifold portions. The uni-bore manifold creates a less turbulent flow path and allows draining of the manifold through one or more valves coupled to an end of the manifold that otherwise can become restricted or plugged with particles entrained in fluids in the manifold.

18 Claims, 14 Drawing Sheets

UNI-BORE DUMP LINE FOR FRACTURING MANIFOLD

CROSS REFERENCE TO RELATED APPLICATIONS

This application claims priority to and is a continuation-in-part of U.S. Non-Provisional application Ser. No. 12/631,834, filed Dec. 6, 2009, which claims the benefit of U.S. Provisional Application No. 61/231,252, filed on Aug. 4, 2009.

STATEMENT REGARDING FEDERALLY SPONSORED RESEARCH OR DEVELOPMENT

Not applicable.

REFERENCE TO APPENDIX

Not applicable.

BACKGROUND OF THE INVENTION

1. Field of the Invention

The disclosure generally relates to oilfield applications having multiple fluid lines for servicing wells. More particularly, the disclosure relates to oilfield applications having manifolds that carry slurries with liquids and particles.

2. Description of the Related Art

FIG. 1A is an exemplary schematic diagram of a prior art fracturing system for an oilfield fracturing operation. FIG. 1B is an exemplary schematic diagram of a prior art fracturing system, showing fractures in an underlying formation. FIG. 1C is an exemplary schematic diagram of the prior art fracturing system of FIG. 1A detailing a system for one well. The figures will be described in conjunction with each other. Oilfield applications often require pumping fluids into or out of drilled well bores 22 in geological formations 24. For example, hydraulic fracturing (also known as "fracing") is a process that results in the creation of fractures 26 in rocks, the goal of which is to increase the output of a well 12. Hydraulic fracturing enables the production of natural gas and oil from rock formations deep below the earth's surface (generally 5,000-20,000 feet). At such depths, there may not be sufficient porosity and permeability to allow natural gas and oil to flow from the rock into the wellbore 22 at economic rates. The fracture 26 provides a conductive path connecting a larger area of the reservoir to the well, thereby increasing the area from which natural gas and liquids can be recovered from the targeted formation. The hydraulic fracture 26 is formed by pumping a fracturing fluid into the wellbore 22 at a rate sufficient to increase the pressure downhole to a value in excess of the fracture gradient of the formation rock. The fracture fluid can be any number of fluids, ranging from water to gels, foams, nitrogen, carbon dioxide, or air in some cases. The pressure causes the formation to crack, allowing the fracturing fluid to enter and extend the crack further into the formation.

To keep the fractures open after the injection stops, propping agents are introduced into the fracturing fluid and pumped into the fractures to extend the breaks and pack them with proppants, or small spheres generally composed of quartz sand grains, ceramic spheres, or aluminum oxide pellets. The proppant is chosen to be higher in permeability than the surrounding formation, and the propped hydraulic fracture then becomes a high permeability conduit through which the formation fluids can flow to the well.

In general, hydraulic fracturing equipment used in oil and natural gas fields usually includes frac tanks with fracturing fluid coupled through hoses to a slurry blender, one or more high-pressure, high volume fracturing pumps to pump the fracturing fluid to the well, and a monitoring unit. Associated equipment includes fracturing tanks, high-pressure treating iron, a chemical additive unit (used to monitor accurately chemical addition), pipes, and gauges for flow rates, fluid density, and treating pressure. Fracturing equipment operates over a range of pressures and injection rates, and can reach up to 15,000 psi (100 MPa) and 100 barrels per minute (265 L/s). Many frac pumps are typically used at any given time to maintain the very high, required flow rates into the well.

In the exemplary prior art fracturing system 2, fracturing tanks 4A-4F (generally "4") deliver fracturing fluids to the well site and specifically to one or more blenders 8. The tanks 4 each supply the fluids typically through hoses 6A-6F (generally "6") or other conduit to one or more blenders 8. One or more proppant storage units 3 can be fluidicly coupled to the blenders 8 to provide sand or other proppant to the blenders. Other chemicals can be delivered to the blenders for mixing. In most applications, the blenders 8 mix the fracturing fluids and proppant, and delivers the mixed fluid to one or more trucks 5A-5E (generally "5") having high-pressure pumps 9A-9F (generally "9") to provide the fluid through one or more supply lines 10A-10E (generally "10") to a well 12A (generally "12"). The fluid is flushed out of a well using a line 14 that is connected to a dump tank 16. The fracturing operations are completed on the well 12A, and can be moved to other wells 12B and 12C, if desired.

One of the significant challenges in fracturing operations is the large number of trucks, pumps, containers, hoses or other conduits, and other equipment for a fracturing system. While FIG. 1B is a graphic artist's schematic helpful for understanding larger components of a fracturing system, and FIG. 1C is helpful for schematically linking the components, the systems of FIGS. 1B and 1C are vastly simplified. The reality of a well site is shown in FIGS. 2A and 2B. The complexity and the equipment, piping, and hoses required just for one well is significant and expensive. Further, the equipment and connections are disassembled, relocated, and reassembled for the next well, further adding to increased costs for performing fracturing jobs on a field having multiple wells. The difficulty of working around the wells with the large number of components also causes safety issues.

FIG. 2A is a pictorial representation of a well site facing toward a single well, showing the equipment for fracturing the well including a conglomeration of multiple blenders, pumps, piping, hoses, and other lines. FIG. 2B is a pictorial representation of the well site shown in FIG. 2A taken from the well facing outward to the equipment. The figures will be described in conjunction with each other. The blenders 8 provide the mixed fluids through several blender lines 11 to a trailer 20 having a low-pressure input line 21 that aggregates the fluid from the blender lines. The low-pressure input line 21 flows the fluid into a low pressure outline 23 from which several pump input lines 25 coupled thereto receive the fluid and deliver the fluid to the high-pressure pumps 9. The pumps 9 provide high-pressure fluid through a pump output line 27 to a high-pressure input line 28 on the trailer 20. Several supply lines 10, coupled to the high-pressure input line 28, deliver fluid to the well 12 for the fracturing. Some supply lines have further connections to high-pressure pump output lines to increase capacity adding to the complexity of the piping system. For example, as shown in FIG. 2B, a supply line 10A is also coupled directly with a pump output line 27A and supply line 10B is also coupled directly with a pump output line 27B.

Recently, efforts in the industry have been directed to more efficiently fracture multiple wells at a given field. The number of assembled equipment components has raised even further the complexity level of the system and the ability to operate in and around the multiple wells. One need for an improved system is to provide a better transfer of the fluid from the many sources to the well.

Copending application Ser. No. 13/006,272 describes a solution of an adjustable modular skid system having one or more manifolds for aggregating the typical hoses and other conduits in a typical oil field services system. Flushing and otherwise draining the manifolds can be necessary, for example, when disassembling the manifolds for use at other locations or for other operations, or when flushing the manifolds with clean water. It is preferred to drain the manifolds through the last portion of the manifolds, that is, the ends of the manifolds. However, the manifolds may fill and become restricted or plugged on one or more ends of the manifolds and other non-flowing portions of the manifolds. Draining the manifolds can become problematic with restricted or plugged lines. Further, pressure spikes in the plugged portions can lead to pipe burst. Even if other portions of the system are drained prior to disassembly, any remaining pressure between the portion to be disassembled and the plugged section can cause an unsafe pressure release at disassembly.

There remains a need for an improved system to enhance the ability to flow fluid through the manifolds and drain the manifolds, and particularly drain the ends of the manifolds.

BRIEF SUMMARY OF THE INVENTION

The disclosure provides one or more manifolds having manifold portions primarily of fluid conduit and flow components mounted to the manifold portions, such as valves and fluid fittings. The manifold is formed with a uniform bore, so that the manifold portions are the same size along the flow path of the manifold, and the valves and fluid fittings have a bore the same size of the bore of the manifold portions. The to uni-bore manifold creates a less turbulent flow path and allows draining of the manifold through one or more valves coupled to an end of the manifold that otherwise can become restricted or plugged with particles entrained in fluids in the manifold.

The disclosure provides an oil field manifold system for flowing fluids having particles entrained therein, comprising: one or more manifold portions having a bore for flowing fluids therethrough; and one or more valves, fluid fittings, or a combination thereof coupled to the manifold portions; the manifold having a bore at a beginning of the manifold with a bore at the end of the manifold being the same size as the bore at the beginning; the valves, fluid fittings, or a combination thereof having a bore the same size as the bore at the beginning of the manifold.

The disclosure provides an oil field manifold system for flowing fluids having particles entrained therein, comprising: a first module disposed at a beginning of a manifold; and an end module disposed at an end of the manifold. The first module comprises a support frame; one or more manifold portions coupled to the frame, the manifold portions having a bore for flowing fluids therethrough; one or more valves, fluid fittings, or a combination thereof coupled to the manifold portions having a bore for flowing fluids therethrough that is the same size as the bore of the manifold portions. The end module comprises a support frame; one or more manifold portions coupled to the frame, the manifold portions having a bore for flowing fluids therethrough; one or more valves, fluid fittings, or a combination thereof coupled to the manifold portions having a bore for flowing fluids therethrough that is the same size as the bore of the manifold portions; and the bore of the manifold portions coupled to the end module being the same size as the bore of the manifold portion coupled to the first module.

DETAILED DESCRIPTION

The Figures described above and the written description of specific structures and functions below are not presented to limit the scope of what Applicant has invented or the scope of the appended claims. Rather, the Figures and written description are provided to teach any person skilled in the art to make and use the inventions for which patent protection is sought. Those skilled in the art will appreciate that not all features of a commercial embodiment of the inventions are described or shown for the sake of clarity and understanding. Persons of skill in this art will also appreciate that the development of an actual commercial embodiment incorporating aspects of the present disclosure will require numerous implementation-specific decisions to achieve the developer's ultimate goal for the commercial embodiment. Such implementation-specific decisions may include, and likely are not limited to, compliance with system-related, business-related, government-related, and other constraints, which may vary by specific implementation, location and from time to time. While a developer's efforts might be complex and time-consuming in an absolute sense, such efforts would be, nevertheless, a routine undertaking for those of ordinary skill in this art having benefit of this disclosure. It must be understood that the inventions disclosed and taught herein are susceptible to numerous and various modifications and alternative forms. The use of a singular term, such as, but not limited to, "a," is not intended as limiting of the number of items. Also, the use of relational terms, such as, but not limited to, "top," "bottom," "left," "right," "upper," "lower," "down," "up," "side," and the like are used in the written description for clarity in specific reference to the Figures and are not intended to limit the scope of the invention or the appended claims. Where appropriate, some elements have been labeled with an "A or "B" to designate a member of a series of elements, or to describe a portion of an element. When referring generally to such elements, the number without the letter can be used. Further, such designations do not limit the number of elements that can be used for that function.

The disclosure provides one or more manifolds having manifold portions primarily of fluid conduit and flow components mounted to the manifold portions, such as valves and fluid fittings. The manifold is formed with a uniform bore, so that the manifold portions are the same size along the flow path of the manifold, and the valves and fluid fittings have a bore the same size of the bore of the manifold portions. The uni-bore manifold creates a less turbulent flow path and allows draining of the manifold through one or more valves coupled to an end of the manifold that otherwise can become restricted or plugged with particles entrained in fluids in the manifold.

Figure 3A:
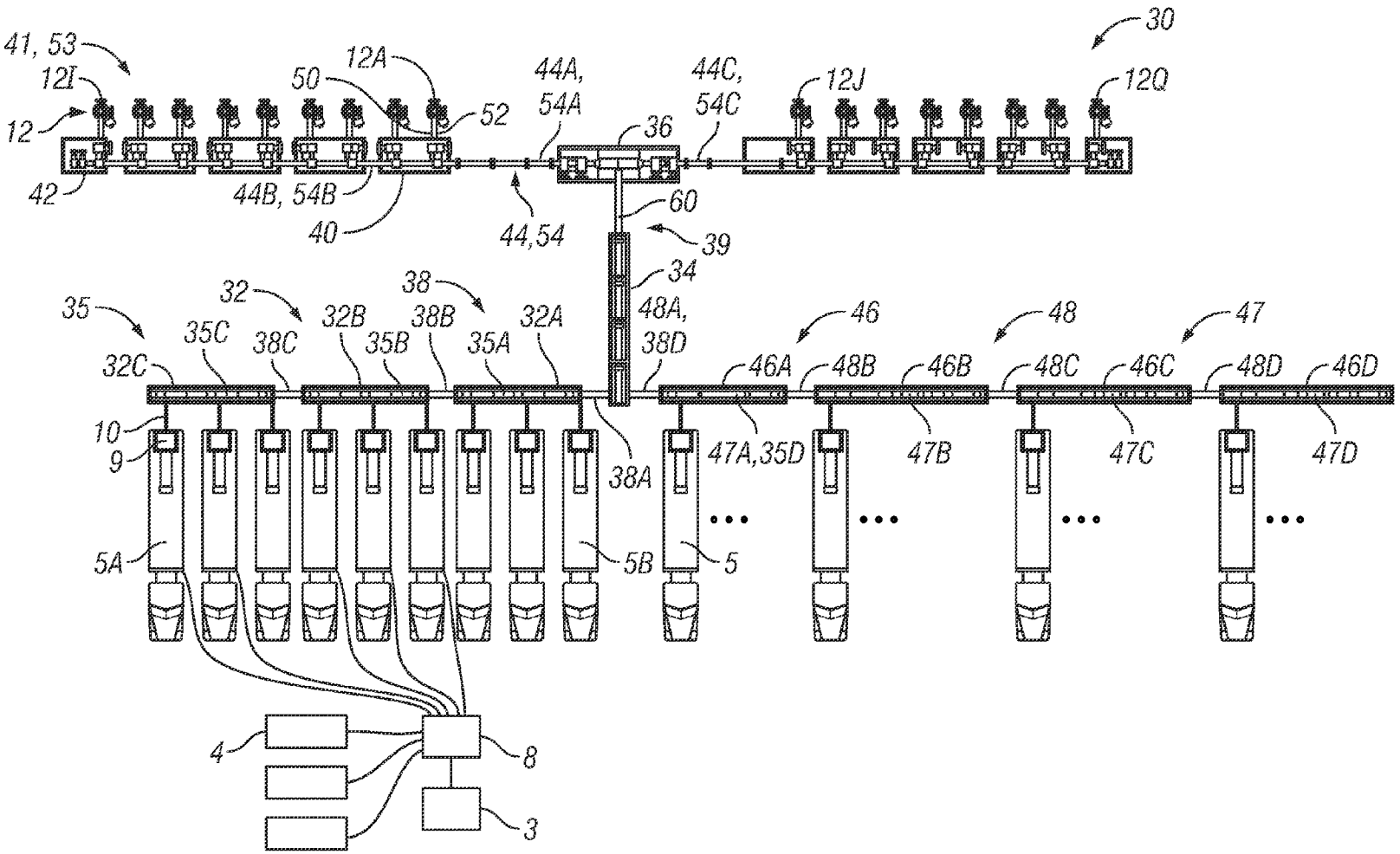
FIG. 3A is an exemplary schematic diagram of a modular skid mounted system according to the invention.
Figure 3B:
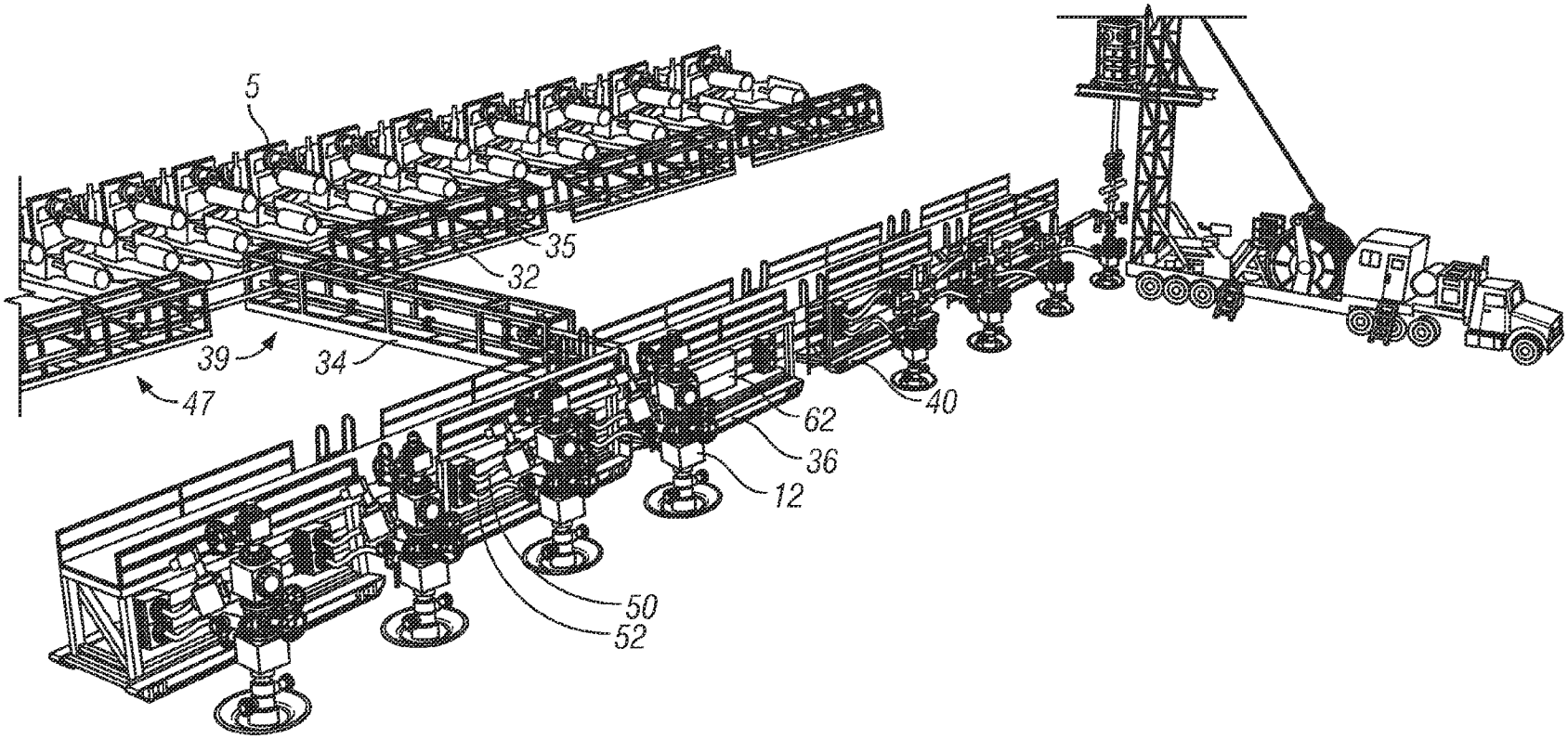
FIG. 3B is an exemplary perspective schematic diagram of the modular skid mounted system shown in FIG. 3A.
Figure 4A:
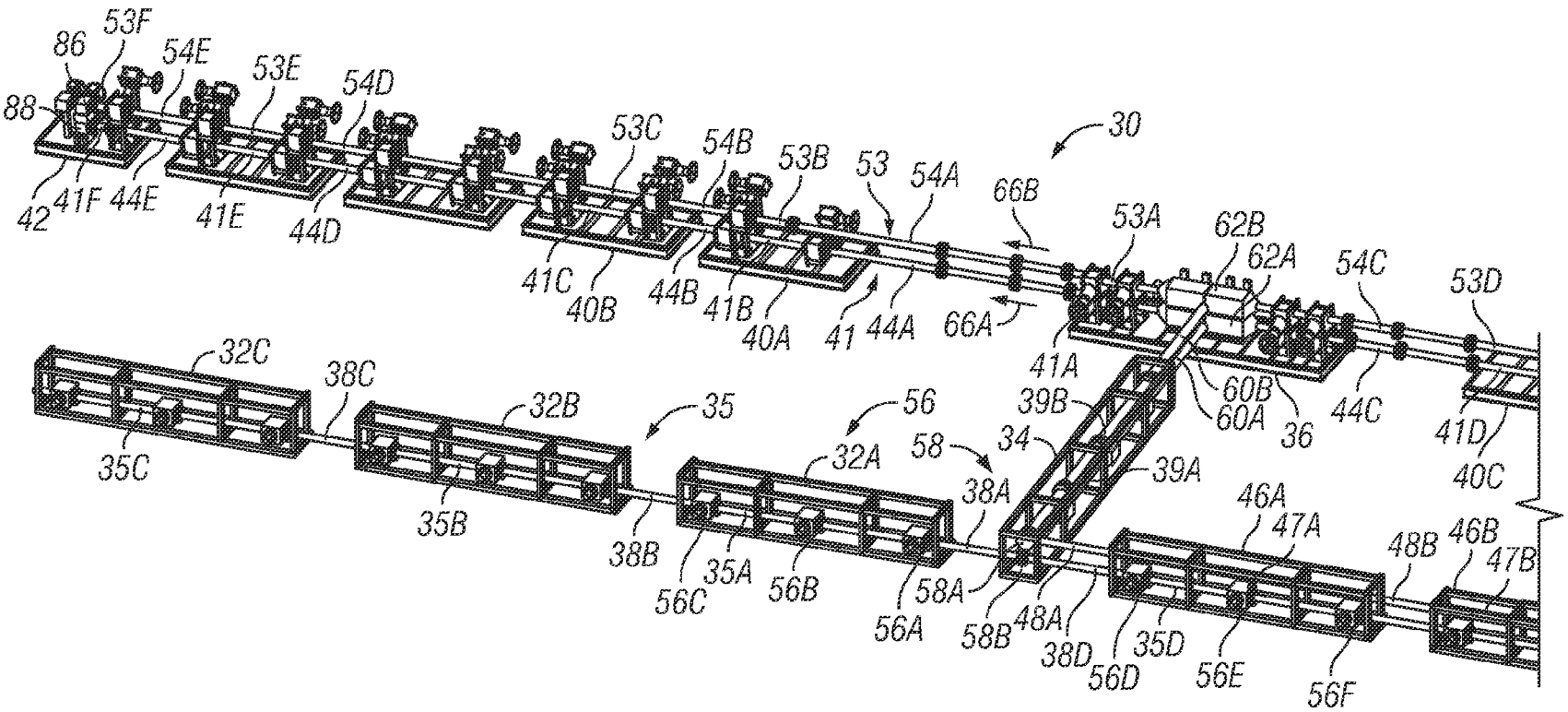
FIG. 4A is a perspective schematic diagram of the skid mounted system shown in FIG. 3A.
Figure 4B:
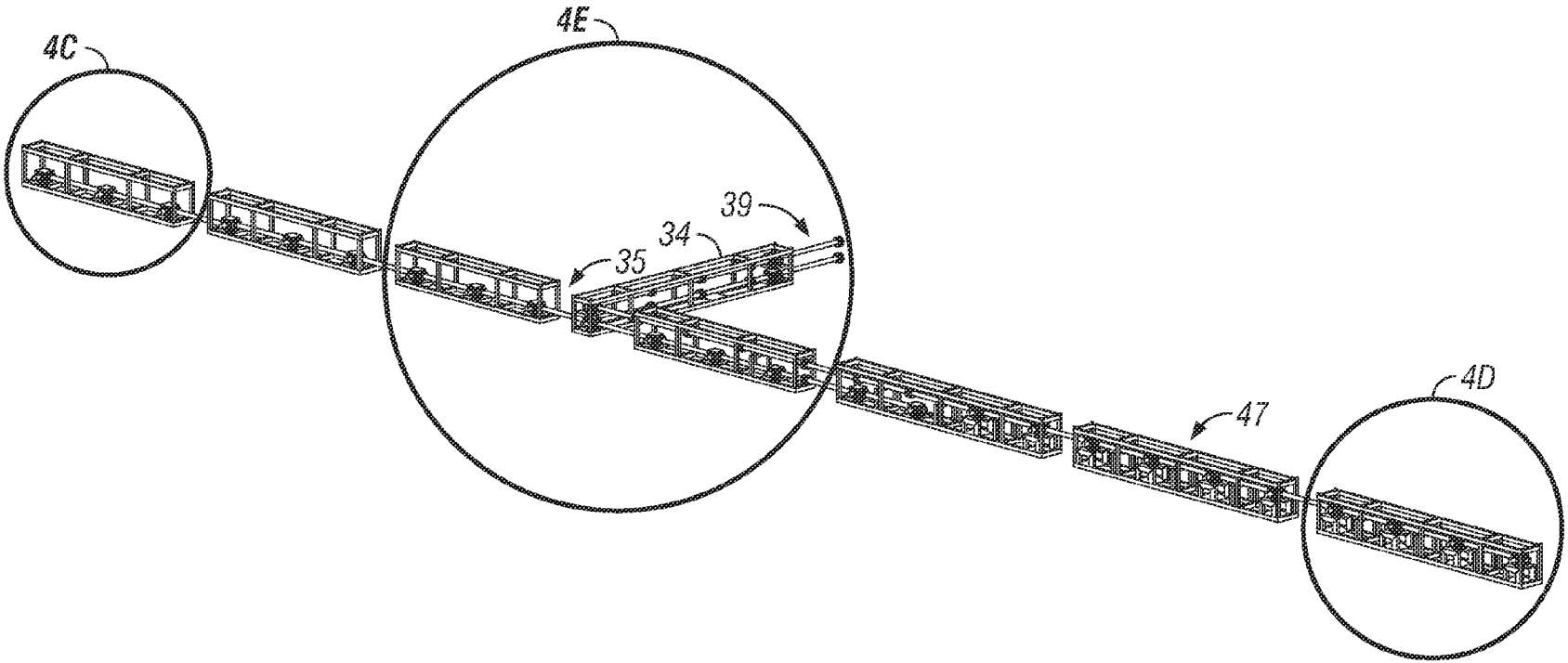
FIG. 4B is a perspective schematic diagram of a supply manifold portion of the skid mounted system shown in FIG. 4A.
Figure 4C:
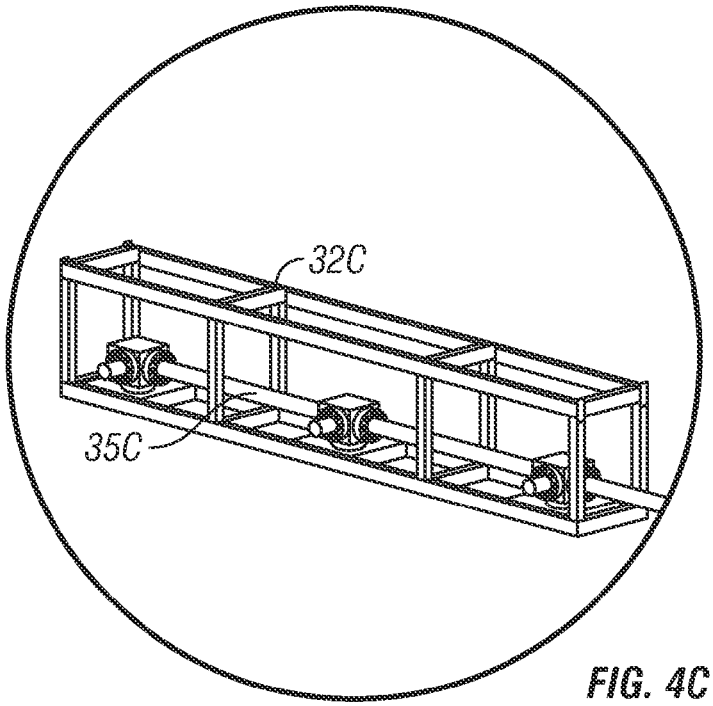
FIG. 4C is a perspective schematic diagram of a supply module for a first supply manifold shown in FIG. 4B.
Figure 4D:
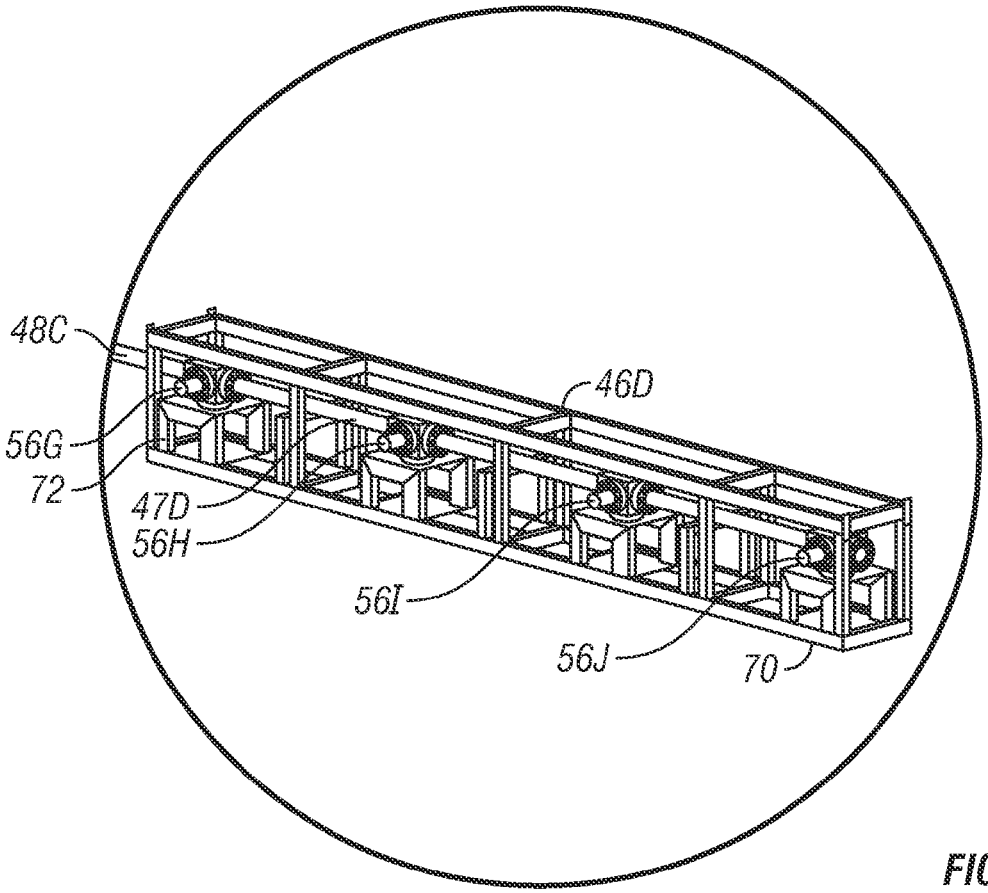
FIG. 4D is a perspective schematic diagram of another supply module for a second supply manifold shown in FIG. 4B.
Figure 4E:
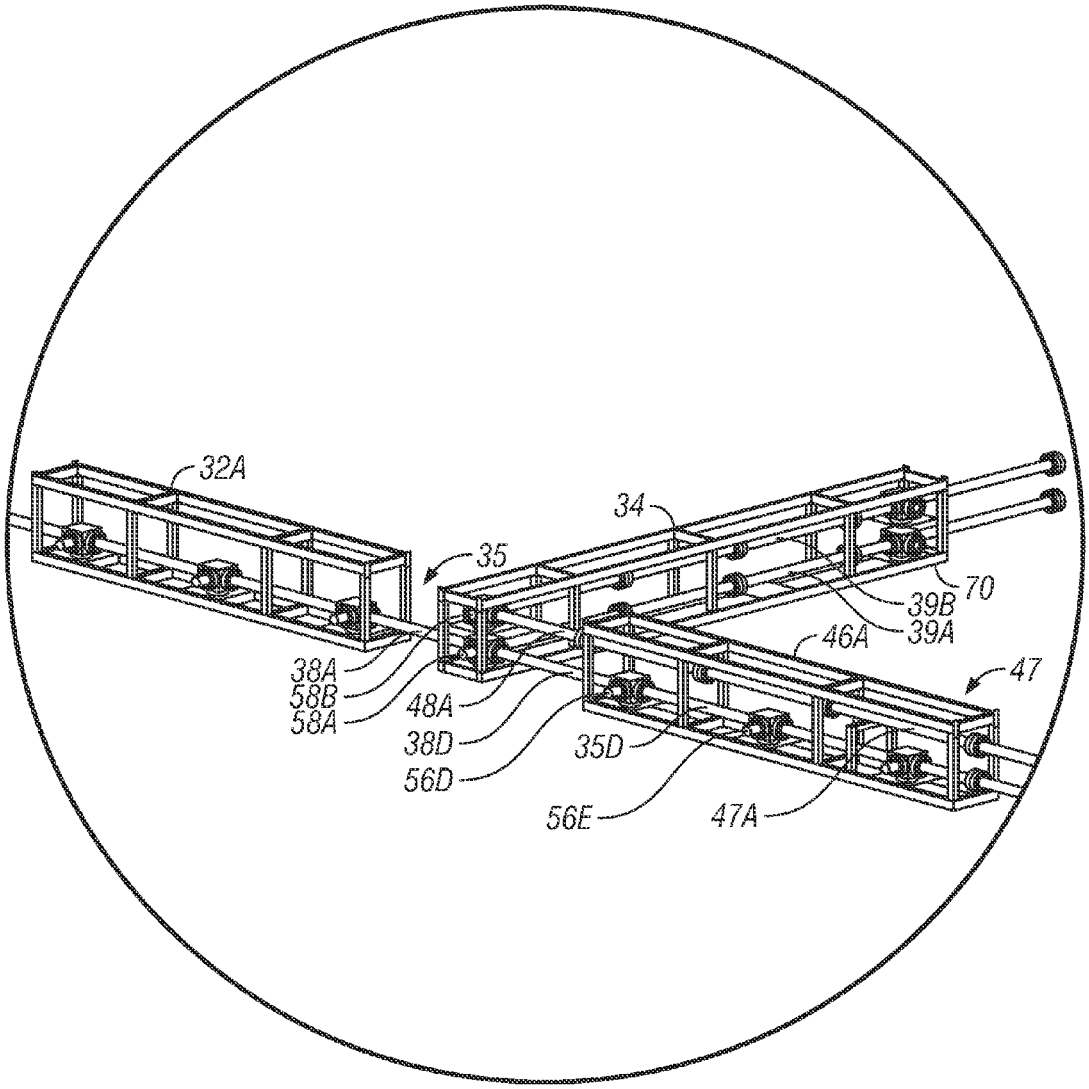
FIG. 4E is a perspective schematic diagram of supply modules coupled to a transition module shown in FIG. 4B.

FIG. 3A is an exemplary schematic diagram of a modular skid mounted system according to the invention. FIG. 3B is an exemplary perspective schematic diagram of the modular skid mounted system shown in FIG. 3A. FIG. 4A is a perspective schematic diagram of the skid mounted system shown in FIG. 3A. FIG. 4B is a perspective schematic diagram of a supply manifold portion of the skid mounted system shown in FIG. 4A. FIG. 4C is a perspective schematic diagram of a supply module for a first supply manifold shown in FIG. 4B. FIG. 4D is a perspective schematic diagram of another supply module for a second supply manifold shown in FIG. 4B. FIG. 4E is a perspective schematic diagram of supply modules coupled to a transition module shown in FIG. 4B. The figures will be described in conjunction with each other.

A modular skid system 30 generally includes a plurality of skid modules with components mounted thereon that are coupled together to form one or more supply manifolds, transition manifolds, and distribution manifolds. The skid modules have a frame with support members for supporting the elements mounted thereon. A fluid manifold can be formed by coupling portions of the manifold and associated flow components such as valves and fluid fittings, which are mounted and supported on the individual modules with fluid lines between the portions to collectively form the manifold. The manifold establishes a flow path for flowing fluids through the manifold.

Various fluid fittings can be disposed at locations along the manifold to receive fluids, conduct fluids to another location, and distribute fluids, as appropriate for the particular manifold and location. Importantly, the modular skid system 30 can be assembled in a plurality of arrangements to fit the particular well site location. An exemplary "I" pattern of the skid system 30 is illustrated in FIG. 3A. However, other patterns are possible and contemplated due to the flexibility of coupling between the modules. For example, a supply manifold supported in modular fashion by the skid modules can be arranged in a "U" shape, "L" shape, "H" shape, or other configurations.

Similarly, a distribution manifold supported in modular fashion can be modified for a variety of well locations and arrangements. Such coupling can occur by using fluid lines between the modules in combination with ells, tees, crosses, and other fittings that can be mounted to the skid modules and the portions of the manifolds thereon. In at least one embodiment, the components can be assembled together in a manufacturing facility, pretested as a system, disconnected into the modules, and shipped to a site for positioning and connection therebetween. The connections can be minimal, such as coupling one or more lines between the modules to install the various manifolds at the well site. The lines used herein can include any variety of lines that can be used to flow fluid, and are generally coupled to one or more other fluid components. Such lines include flanged joints typically known as "spools", pipes, conduit, hoses, threaded connections, couplings, and other pipes and fittings that can be used to flow fluids between starting and ending points for a given manifold.

For the non-limiting, exemplary embodiment shown in FIGS. 3A-4E, a series of skid supply modules 32A, 32B, 32C (generally "32") can support portions 35A, 35B, 35C, respectively, of a first supply manifold (generally "35"). A plurality of fluid lines 38B, 38C fluidicly couple the portions 35A, 35B, 35C together to form a section of the first supply manifold. Further, the supply modules can support additional supply manifolds that can be fluidicly separate from each other. For example, a series of supply modules 46A through 46D (generally "46") can support portions 47A through 47D, respectively, of a second supply manifold (generally "47"). A plurality of fluid lines 48B through 48D fluidicly couple the portions 47A through 47D together to form the second supply manifold 47. Some modules, such as modules 46A, 46B, may support portions of both the first and second supply manifolds. Generally, the skid modules will have a frame with support members to support the components on the skid module, such as frame 70 with support members 72 shown in module 46D. The number of modules can vary from one to many as appropriate for a given well site.

Generally, each of the supply manifold portions on each supply module will have a supply inlet to allow fluids to be delivered into the supply manifold. Some supply modules can have one or more supply inlets for the first supply manifold and other supply modules can have one or more supply inlets for the second supply manifold. Some supply modules can have supply inlets for multiple manifolds. The particular configuration can vary. For example, the supply module 32A can include one or more supply inlets 56A, 56B, 56C (generally, "56") for the portion 35A of the first supply manifold 35. Exemplary fluid fittings for the supply inlets can be ells disposed in the manifolds, so that fluid can enter through a branch on the ell, and join with other fluid flowing through the ell. Another exemplary fluid fitting can be a cross having multiple branches, so that fluid can enter the manifold through one or more branches to join other fluid flowing through the cross. The supply modules 46A can include one or more supply inlets 56D, 56E, 56F for the portion 35D of the first supply manifold 35, but no supply inlets for the portion 47A of the second supply manifold. Thus, the supply modules 46A allow fluid to be delivered into the first manifold 35, but acts as a support for the second supply manifold portion 47A as fluid therein is conducted to other elements of the system. The first supply manifold can be stopped at the supply module 46B and the second supply manifold 47 can continue to the supply module 46D. The supply module 46D can include one or more supply inlets 56G through 56J for the portion 47D of the second supply manifold 47.

The supply modules can be arranged to receive fluid from a supply source. For to example, a plurality of supply tanks 4 can provide fluid to a blender 8. A proppant supply 3 can be fluidicly coupled to the blender 8 for mixing with the fluid from the supply tanks 4. The blender 8 can provide the mixed fluid to one or more trucks 5A with pumps 9 for pumping through the lines 10 to the supply inlets 56 on the supply modules 32 for the first supply manifold 35. Other trucks 5B may carry their own fluid and proppant and provide the fluids directly through various supply inlets 56 into the first supply manifold 35. Other trucks 5 can similarly be positioned to connect the line 10 to the supply modules 46 for providing fluid to the second supply manifold 47. The modularity of the system with manifolds that combine the flows allows a higher number of fluid sources and pumps to be used at a given time than typical systems that are constrained to the workspace and limitations in direct coupling of pump outputs to the well.

One or more supply manifolds can be fluidicly coupled to one or more transition manifolds for conducting the fluid therein to another location at the well site. One or more transition modules can support the transition manifolds or portions thereof in a similar manner as described for the supply modules. For example, the first supply manifold 35 from the supply module 32A can be fluidicly coupled through a fluid line 38A to a first transition manifold 39A (generally "39"). Similarly, another portion 35D of the first supply manifold 35 from the supply module 46A can be coupled through a fluid line 38D to the first transition manifold 39A. The first transition manifold 39A can include a fluid fitting 58A to facilitate the connection to the fluid line 38A, fluid line 38D, or both. The fluid fitting 58A (generally "58") can be an ell, tee, cross, or other appropriate fitting. In the exemplary embodiment shown, a cross is used for the fluid fitting 58A to provide an inlet for both the line 38A and line 38D with a remaining branch of the cross available for another connection to another line from another module, if appropriate. The fluid fittings further allow the transition module to be coupled in a variety of orientations as may be appropriate for a particular well site configuration.

Similarly, the second supply manifold 47 from the supply module 46A can be coupled through a fluid line 48A to a second transition manifold 39B. The second transition manifold 39B can include a fluid fitting 58B to facilitate the connection to the fluid line 48A. The fluid fitting 58B can be an ell, tee, cross, or other appropriate fitting. In the embodiment shown, a cross is used for the fluid fitting 58B to provide an inlet for the line 48A with remaining branches of the cross available for other connections if appropriate.

The transition manifolds supported by the transition module 34 can be fluidicly coupled to fluid components supported by at least one collection module 36 that is distal from the supply modules. The collection module 36 includes components for distributing the incoming fluids from the transition module. For example, the transition manifold 39A from the transition module 34 can be fluidicly coupled through a fluid line 60A (generally "60") to a collection block 62A (generally "62") coupled to the collection module 36. Similarly, the transition manifold 39B can be fluidicly coupled to a collection block 62B through a fluid line 60B. The collection modules 62 can include an inlet for the flow lines 60 and one or more outlets to connect to a first distribution manifold 41 and, in some embodiments, a second distribution manifold 53, each supported by one or more distribution modules 40.

Each distribution module 40 can include one or more portions of the distribution manifold, and various components for distributing the fluids flowing in the distribution manifold to one or more wells 12. In the exemplary embodiment, the collection module 36 can support a portion 41A at a beginning of a first distribution manifold 41, where the portion 41A is coupled to an outlet on the collection block 62A. One or more distribution modules 40A, 40B (generally "40") can support other portions of the first distribution manifold 41, including portions 41B, 41C. The portion 41B of the first distribution manifold on the distribution module 40A can be fluidicly coupled through a fluid line 44A to the portion 41A of the first distribution manifold on the collection module 36. The portion 41C of the first distribution manifold on the distribution module 40B can be fluidicly coupled through a fluid line 44B to the portion 41B of the first distribution manifold on the distribution module 40A.

The collection module 36 can also distribute fluid to another set of wells through another portion of the distribution manifold 41. For example, another outlet of the collection block 62A can be coupled through a fluid line 44C to a portion 41D of another beginning of the first distribution manifold in a different direction, supported by a distribution module 40C. Other number of modules, portions of manifolds, arrangements, and connections can be made.

The second collection block 62B on the collection module 36 can be coupled to a second distribution manifold 53. The second distribution manifold 53 can include one or more fluid lines 54 to couple portions of the second distribution manifold together similar to the first distribution manifold. More specifically for the exemplary embodiment, the distribution modules 40 can also include one or more portions of the distribution manifold 53, and various components for distributing the fluids flowing in the distribution manifold to the wells 12. The second collection block 62B on the collection module 36 can be coupled with a portion 53A of the second distribution manifold 53. The distribution modules 40A, 40B can support portions 53B, 53C, respectively, of the second distribution manifold 53. The portion 53B of the second distribution manifold on the distribution module 40A can be fluidicly coupled through a fluid line 54A to the portion 53A of the second distribution manifold on the collection module 36. The portion 53C of the second distribution manifold on the distribution module 40B can be fluidicly coupled through a fluid line 54B to the portion 53B of the second distribution manifold on the distribution module 40A. Another outlet of the collection block 62A can be coupled through a fluid line 54C to a portion 53D of the second distribution manifold, supported by the distribution module 40C to provide fluid to a different set of wells. Other number of modules, portions of manifolds, arrangements, and connections can be made.

The one or more distribution manifolds 41, 53 can each end at an end module 42. The end module 42 can include various components as needed, including one or more valves 86, 88 for closing off the flow of fluid beyond the end module 42 and draining the manifolds.

Figure 4F:
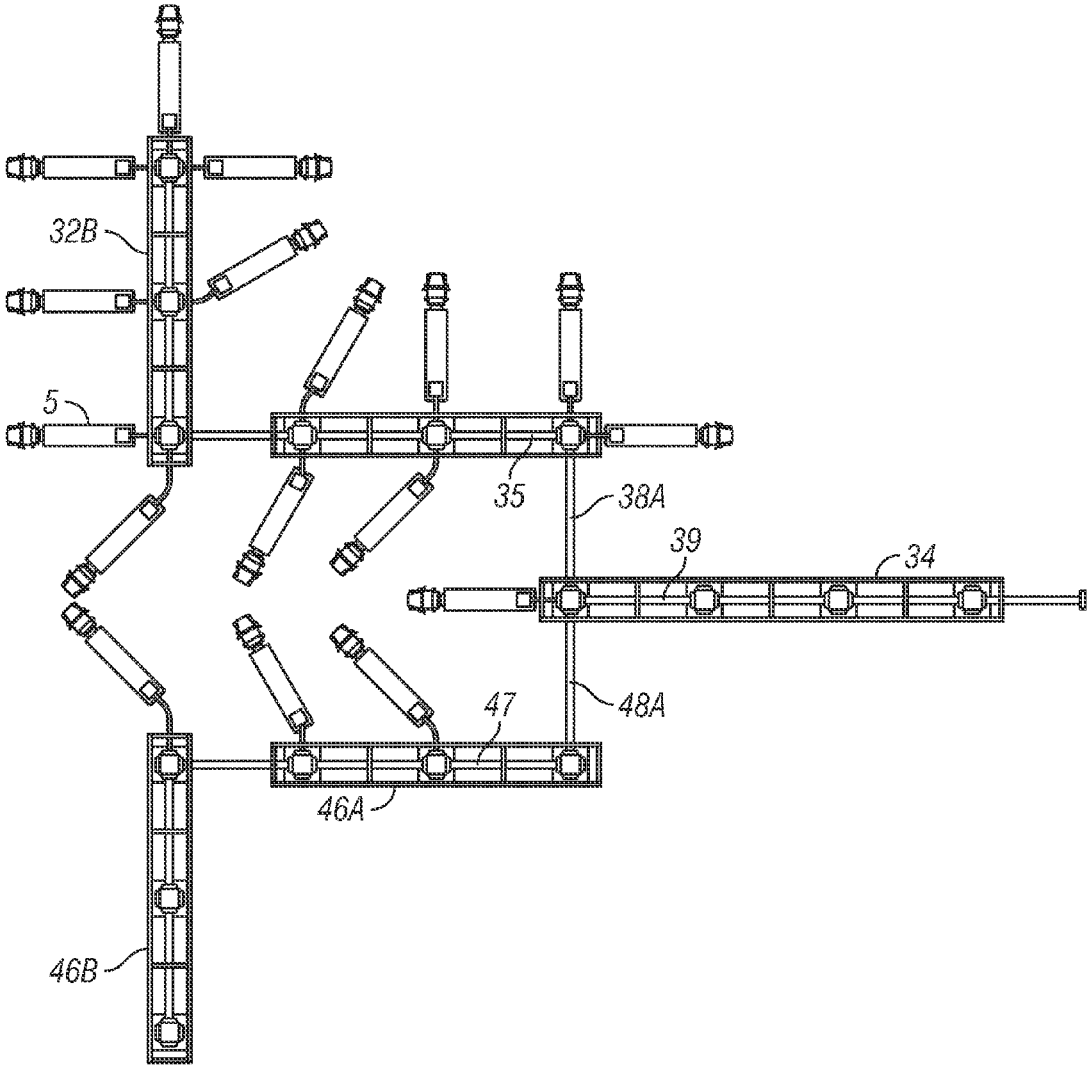
FIG. 4F is another exemplary schematic diagram of a modular skid mounted system according to the invention.

FIG. 4F is another exemplary schematic diagram of a modular skid mounted system according to the invention. In some embodiments, trucks 5 or other supply sources supplying fluid to the supply manifold can be located on both sides of the module. The supply modules 32A, 32B for the supply manifold 35 for the first line are shown on a first side of the transition module 34. The supply modules 46A, 46B for the supply manifold 47 for the second line are shown on a second side of the transition module 34. The first supply manifold 35 and the second supply manifold 47 can each be coupled to a respective manifold supported by the transition module 34 and flow into other components of the system, described herein. The trucks 5 can be arranged on both sides of the supply modules 32, 46. It may be conducive to provide supply inlets with crosses having branches in both directions to facilitate coupling on both sides of the modules. Further, supply inlets can be provided on ends of the modules for coupling with a truck. Further, a truck can be coupled to the transition module as well, such as on an end where the supply manifolds flow into the transition manifolds.

Figure 5:
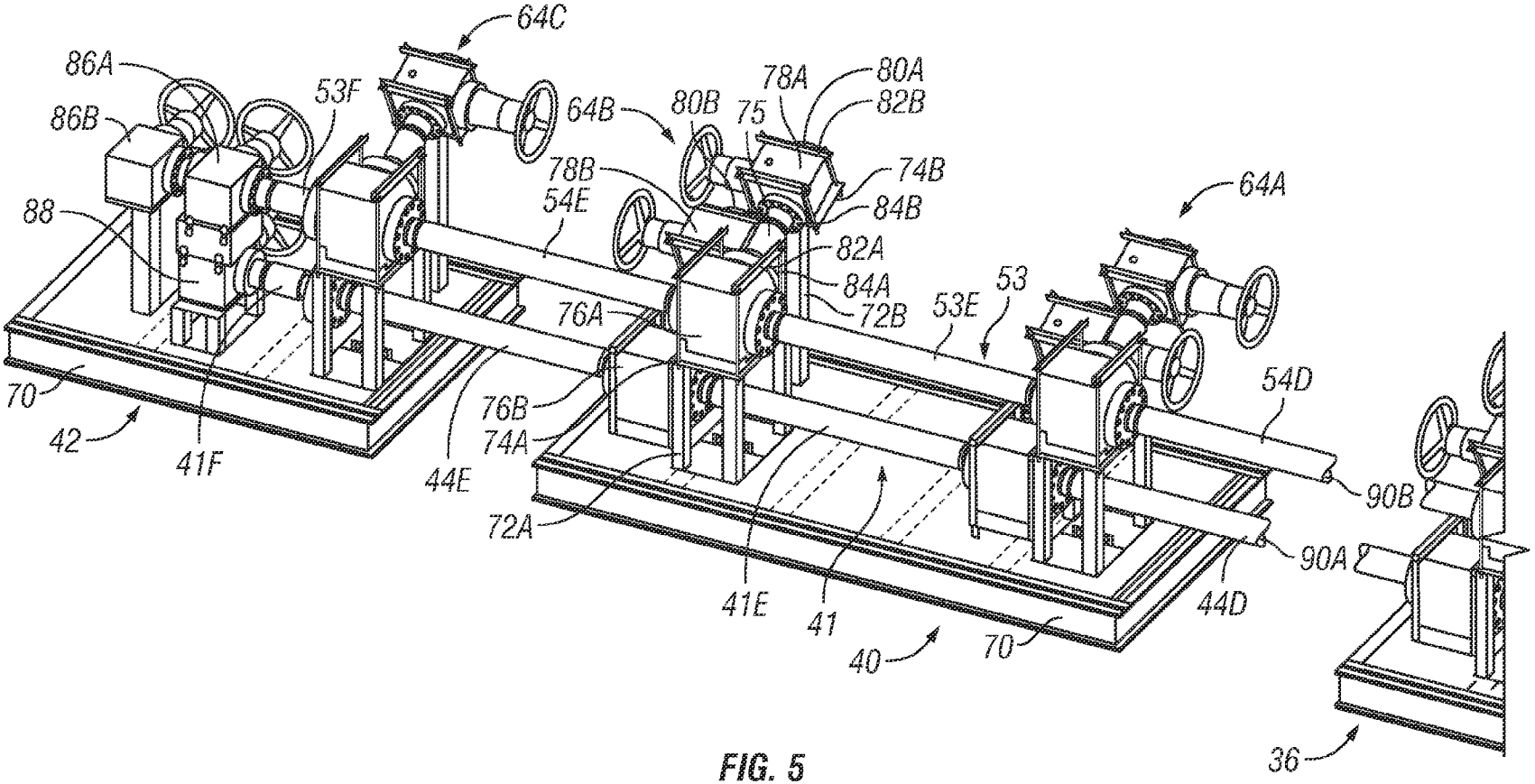
FIG. 5 is a perspective schematic detail view of an exemplary distribution module.
Figure 6:
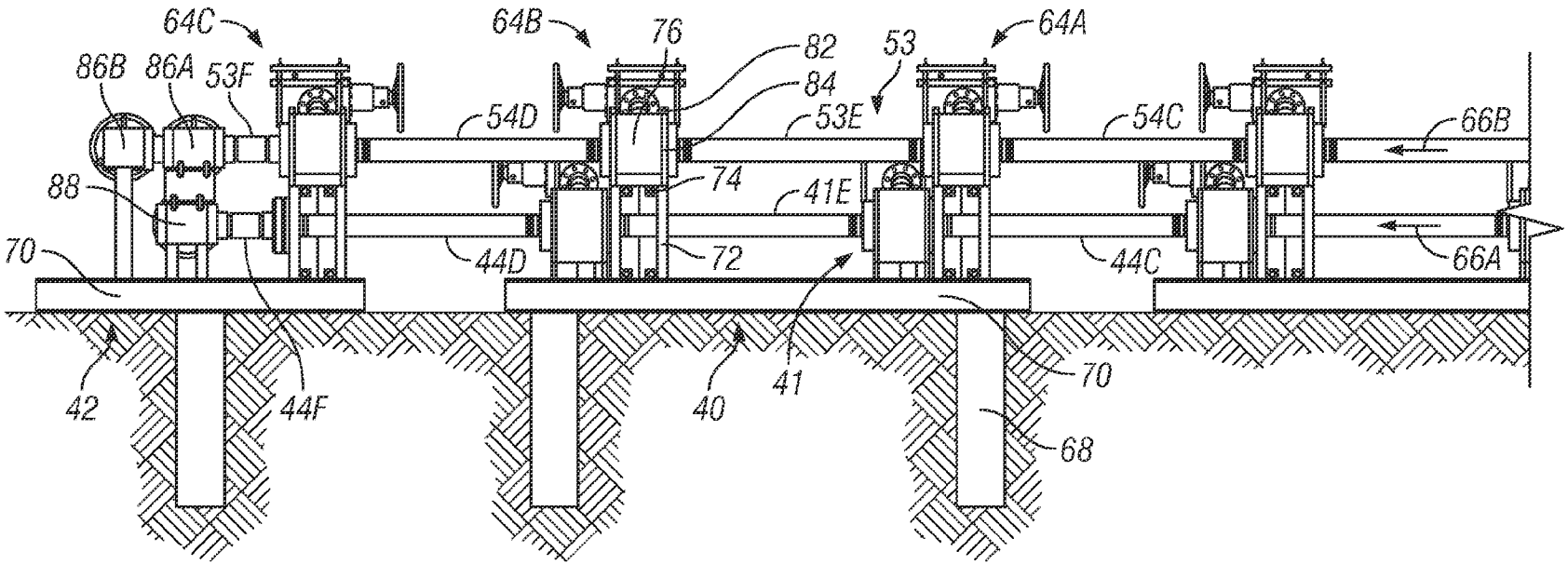
FIG. 6 is a side schematic view of distribution module of FIG. 5.

FIG. 5 is a perspective schematic detail view of an exemplary distribution module. FIG. 6 is a side schematic view of distribution module of FIG. 5. The figures will be described in conjunction with each other. The modules, such as a distribution module 40, can include various structural elements that can be used to couple one or more manifold portions to the module. While the below description references the distribution manifold 40 and equipment applicable to the distribution manifold, similar concept of the frame, supporting members, manifold portions and interconnection fluid lines between the manifolds and associated equipment for a given application apply to other modules described herein.

Figure 1A:
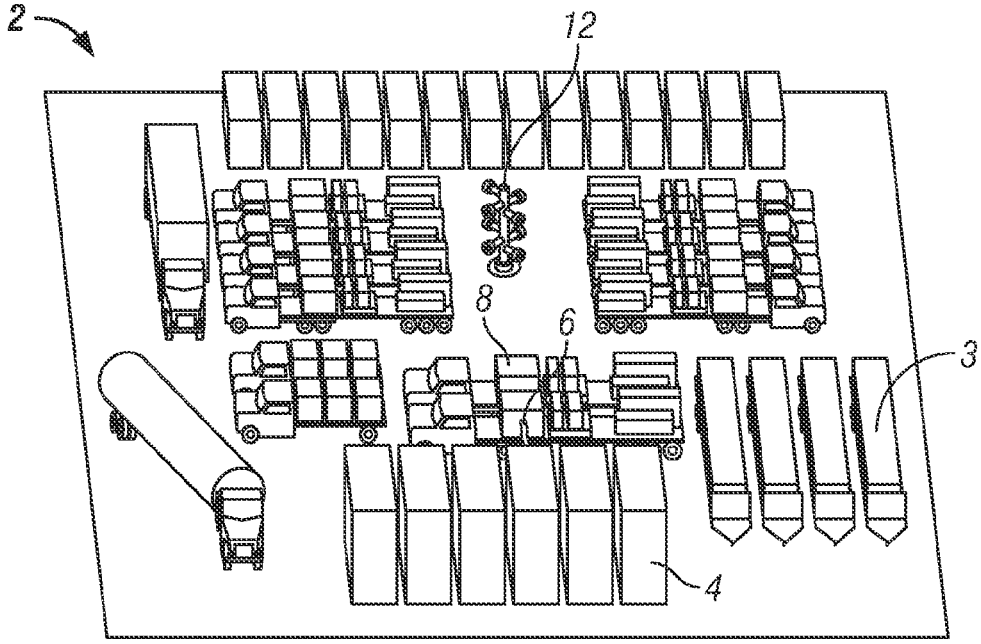
FIG. 1A (Prior Art)
FIG. 1A is an exemplary schematic diagram of a prior art fracturing system for an oilfield fracturing operation.
Figure 1B:
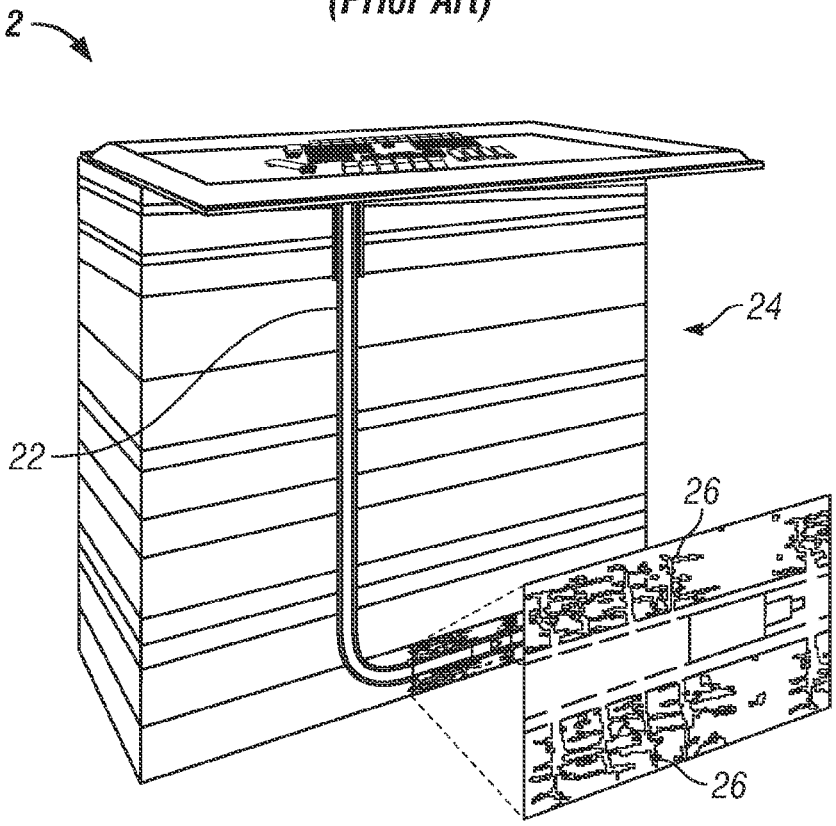
FIG. 1B (Prior Art)
FIG. 1B is an exemplary schematic diagram of a prior art fracturing system, showing fractures in an underlying formation.
Figure 1C:
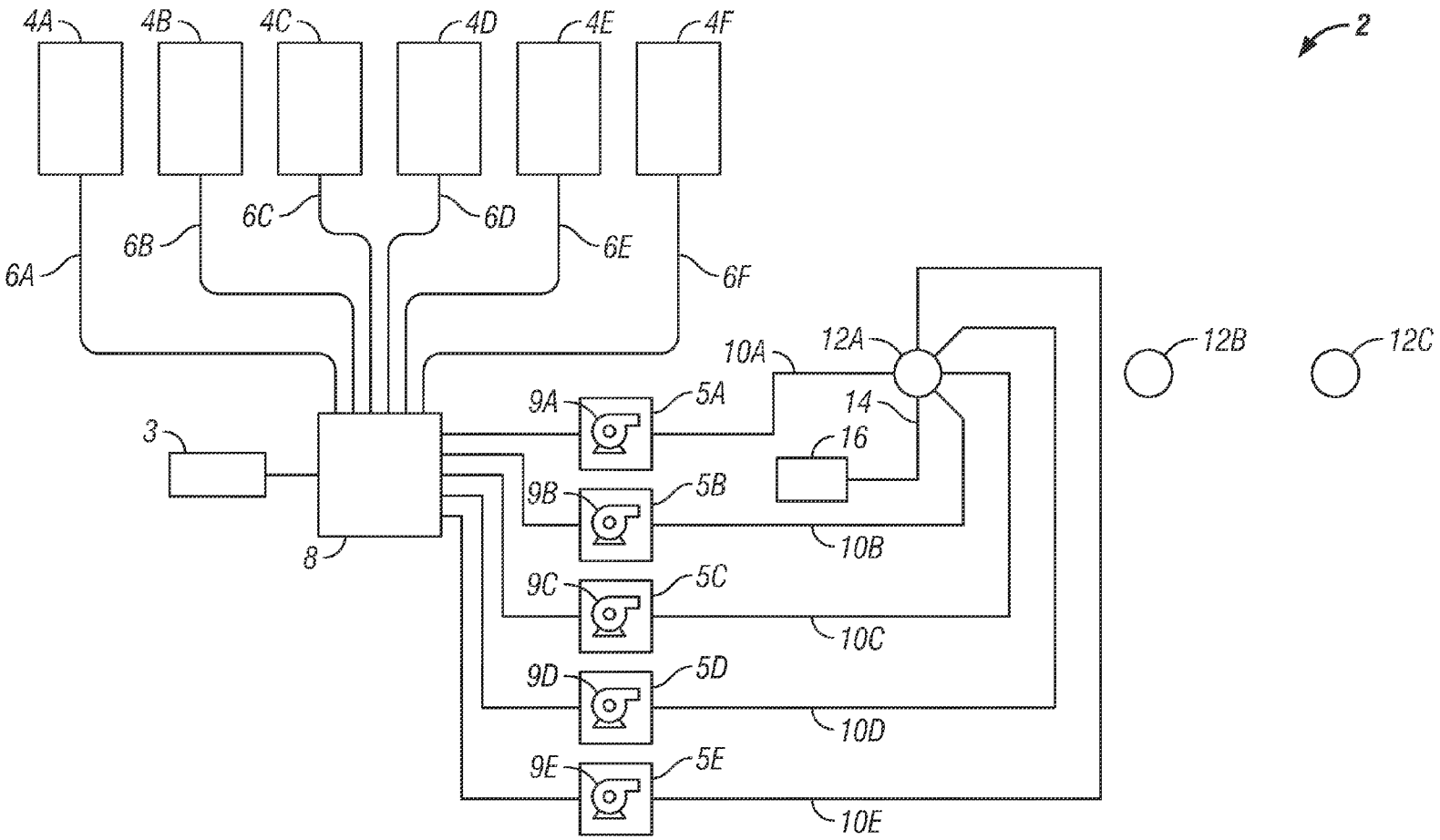
FIG. 1C (Prior Art)
FIG. 1C is an exemplary schematic diagram of the prior art fracturing system shown in FIG. 1A detailing a system for one well.
Figure 2A:
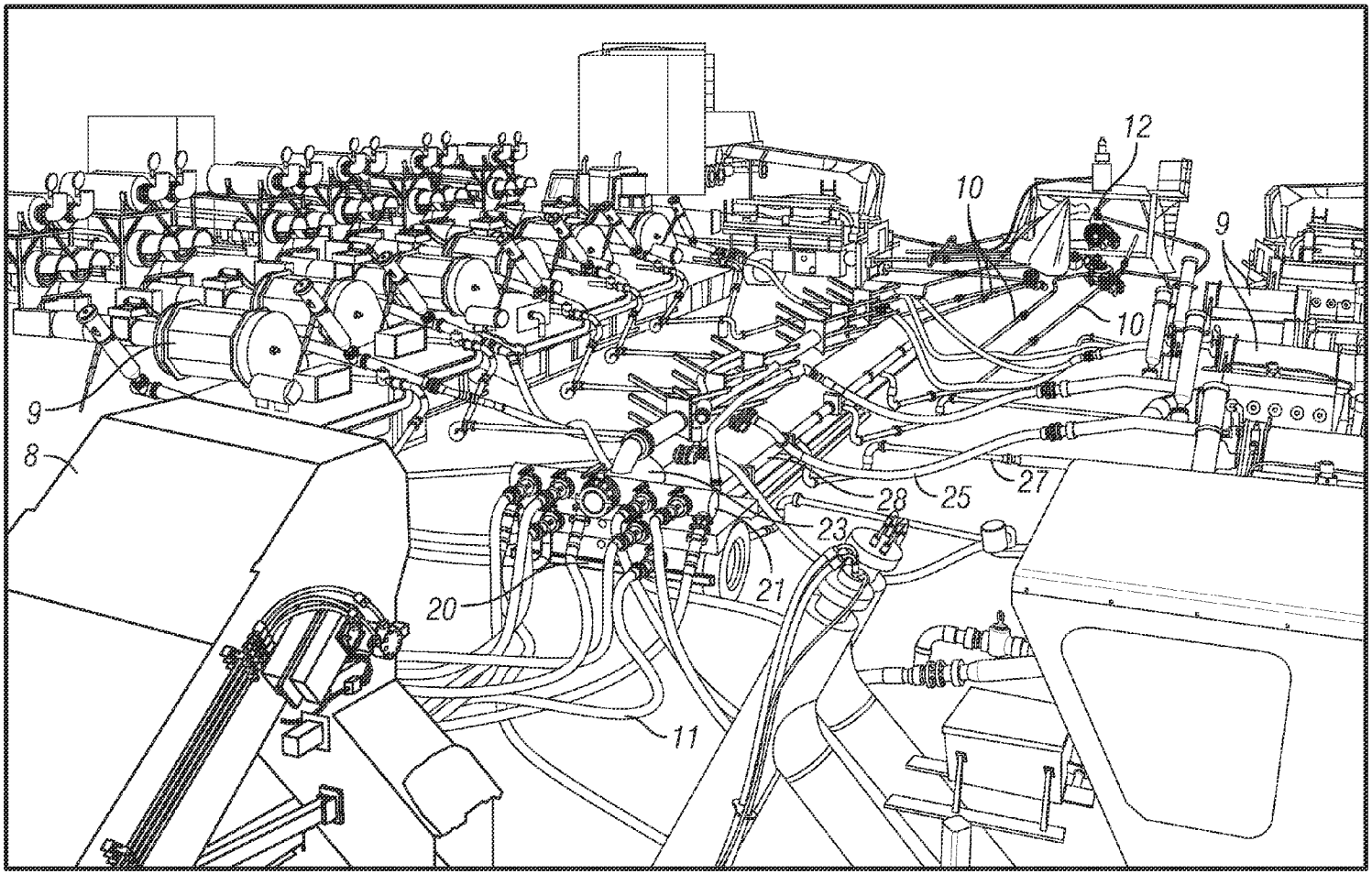
FIG. 2A (Prior Art)
FIG. 2A is a pictorial representation of a well site facing toward a single well, showing the equipment for fracturing the well including a conglomeration of multiple blenders, pumps, piping, hoses, and other lines.
Figure 2B:
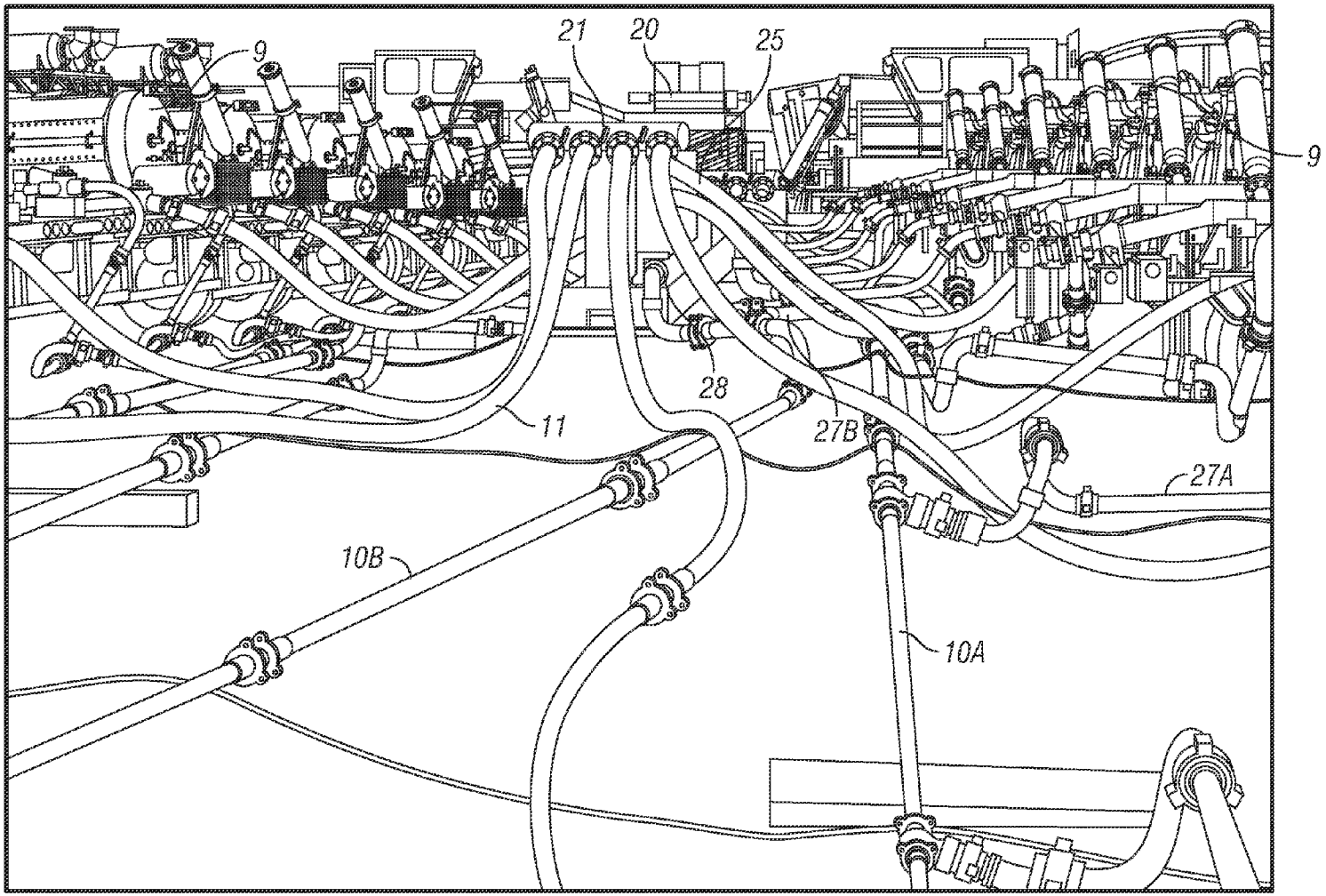
FIG. 2B (Prior Art)
FIG. 2B is a pictorial representation of the well site shown in FIG. 2A taken from the well facing outward to the equipment.

The distribution module 40 can include a frame 70 for supporting the module on a surface, such as the ground or other foundation. The module 40 can support one or more valve groups 64A, 64B used to deliver the fluid from the manifolds to the one or more wells 12, shown in FIG. 2. The manifold portions 41E, 53E can be coupled between the valve groups 64A, 64B, and the valve groups coupled to the frame 70, resulting in the portions 41E, 53E of the manifold being indirectly coupled to the frame. The fluid lines 44E, 54E can be coupled to a distal side of the valve group 64A from the manifold portions 41E, 53E. On the other end of the module 40, the fluid lines 44D, 54D can be coupled to a distal side of the valve group 64B from the manifold portions 41E, 53E.

The frame 70 can be made of structural components, such as braces, beams, plates, and include lifting eyes, brackets, and other components generally included in a skid. The frame 70 can also include one or more support members 72A, 72B (generally "72"). The support members 72 can be used to couple the manifolds and other fluid components to the frame. In some embodiments, the support members can be used to elevate one or more fluid components above a given elevation. Other support members 74A, 74B (generally "74"), such as a mounting plate, can be coupled to the support members 72A, 72B, respectively, for providing a base surface for supporting components, as desired. For example, one or more distribution outlets 76A (generally "76"), such as a tee or cross, can be supported by the support members 72A, 74A. As another example, the valve group 64B can include valves, outlets, and intermediate lines and other components that deliver the fluid from the manifold to the relevant well or wells. The valve group 64B can include one or more valve control units 78A (generally "78") with a well outlet 80A (generally "80") can be supported by the support members 72B, 74B. In the illustration, the distribution outlet 76A can be fluidicly coupled through a branch line 75 to the valve control unit 78A. The module 40 can further couple one or more distribution outlets 76B and valve control units 78B with a well outlet 80B to the frame 70 at a different elevation than the distribution outlets 76A and valve control units 78A, depending on the particular arrangement of components. In some embodiments, the module 40 can provide various numbers of distribution outlets 76, depending on the well spacing to which the fluid flows from the module 40.

The end module 42 can include a frame 70 with components coupled thereto. In at least one embodiment, the end module 42 can include another valve group 64C that can be fluidicly coupled through the lines 44E, 54E to the components of the valve group 64B on the module 40.

One or more valves can be coupled to the ends of the manifolds 41, 53. For example, the manifold 53 can provide fluids with the proppant mixture, such as sand and ceramics. Valves 86A, 86B (generally "86") can be coupled to the end of the manifold 53, where 86A can be a primary valve and valve 86B be a secondary valve. The manifold 41 can provide relatively clean water without substantial quantities of proppant, and valve 88 can be coupled to the end of the manifold 41.

As described above, when the manifold portions on the modules are coupled together, they collectively form the manifolds. Such manifolds include the distribution manifolds 41, 53, that are formed with the manifold portions and valves and fittings through which fluid in the manifolds flow. The manifold establishes a flow path, such as a flow path 66A for the manifold 41 and a flow path 66B for the manifold 53. Other flow paths can similarly be established in other manifolds described herein.

Importantly, the manifold 41 (and other manifolds as appropriate) can be designed to have a bore is the same size along the flow path of the manifold. Further, the bore of the valves or other flow components coupled to the manifold portions can be the same size as the internal bore of the manifold portions, including the valves on the end of the manifold. Generally, the internal bores will be a uniform size, herein termed a "uni-bore." For purposes herein, the term "uni-bore" will also include the internal bore of valves, fittings, and other components installed in the flow path that have the size of internal bore of the manifold portions. Further, the terms "size" of the bore and uni-bore refer to the nominal rated size of the bore and not the exact dimension with tolerances for engineering purposes. For example, a 5" nominal bore could have an engineering dimension of 5.125" with plus or minus tolerances and still be a 5" bore. Further, the bore of the manifold portion could have a variation from the bore of a valve or fitting coupled to the manifold portion, but all still having the same rated bore size and thus have a uni-bore configuration.

The manifolds 41, 53 can have an internal bore 90A, 90B respectively. The manifold portions 41F, 53F at the end of the manifolds 41, 53, shown in FIG. 4, have a bore the same size as the manifold portions 41A, 53A at the beginning of the manifolds 41, 53, shown in FIG. 3A. Further, the distribution outlets 76A, 76B and the valve control units 78A, 78B have a bore the same size as the manifold portions 41A, 53A. Still further, the valves 86, 88 on the ends of the manifolds 41, 53 have a bore the same size as the manifold portions 41A, 53A.

This sizing of the manifold and associated components contrasts with typical designs, for example, in headers that reduce the size of piping as flow is distributed along the flow path of the header. Further, drain valves are typically much smaller in size than the bore that is drained. Placing valves with a bore that is the same size as the manifold bore on the end of the manifold is thus counterintuitive. It is believed that full-bore size valves and components along the flow path reduce turbulent eddies, which cause the proppant and other particles entrained in the fluid to be deposited along the manifold flow path. By maintaining a uni-bore flow path, the turbulence is reduced.

Further, the end module valves with their uni-bore sizing help facilitate flushing and other draining of the manifold. In contrast, the typical drain valve having a smaller bore than the bore of the adjacent manifold necessarily creates a partial blockage in the manifold cross-sectional area and a discontinuity in the flow path. It is believed that such discontinuities create turbulence on draining, causing particles in the draining fluid to be deposited upstream of the small valve and around the discontinuities. The particles can thus accumulate and restrict or plug the manifold upstream of the small valve, resulting in the manifold being unable to drain and/or depressurize. However, a valve having the same size bore as the manifold can drain without having necessarily a partially blocked flow path and the resulting discontinuities. Thus, even if the manifold bore is partially blocked with particles, the uni-bore valve can allow the fluid to drain at any point across the cross-sectional area of the manifold bore. The flow can also erode the partial deposits of particles and flow the particles through the uni-bore valve due to the bore of the manifold being unrestricted by a smaller bore valve.

Returning to the structural aspects of the module 40, the distribution outlets 76A and the valve control units 78A can be held in position by one or more hold down members 82A, 82B (generally "82"), such as a bracket, U-clamp, plate, or other constraining elements. The hold down members 82A, 82B can be coupled to the support members 74A, 74B by one or more couplers 84A, 84B (generally "84"). Alternatively, the couplers 84 can be coupled to other elements of the frame 70 or other appropriate stationary elements. The coupler 84 can include threaded rods, nuts and bolts, pins, and other coupling elements known to those with ordinary skill in the art.

In general, the coupler 84 can be adjustable in compression, tension, or both. It has been found that in some systems, the pulsing generally from pumps that is transmitted through the components can cause at times significant vibration at a natural frequency of the components, the module, or the system in general. Thus, the adjustable couplers 84 provide a way of altering the force that is exerted on the components to couple the components to the module. The altering of the force on the components can change the natural frequency, so that the pulsing is not operating at the natural frequency. The ability to adjust the natural frequencies of vibrations allows for the system to be fine tuned and minimize vibration on the components, module, or system.

In some locations, even the module 40 will be insufficient to support the equipment without settling. While the module itself may provide sufficient structural support to the components supported on the module, the whole module may shift or settle relative to other modules and cause damage to the components that are coupled with other modules. Thus, in one or more embodiments, one or more piles 68 can be used at various locations around the distribution module 40 or other modules contained herein.

Figure 7:
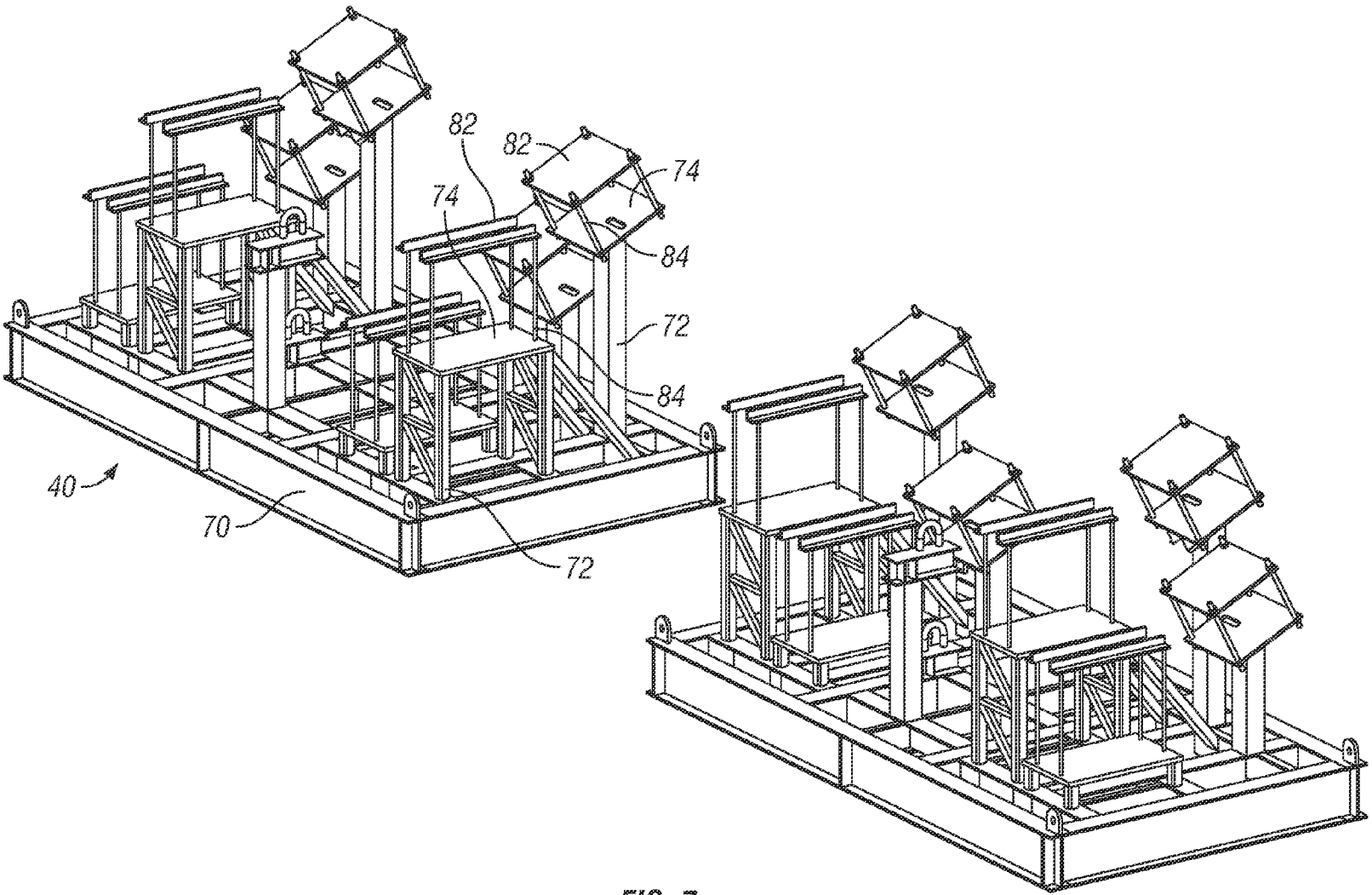
FIG. 7 is a perspective schematic view of the frame and support members of exemplary skid modules.

FIG. 7 is a perspective schematic view of the frame and support members of exemplary skid modules. The distribution module 40, and other modules described herein, can include the frame 70, which can include various structural elements positioned to support one or more fluid components mounted thereon. The support members 72 can be spaced at certain locations and at certain elevations to align with the manifolds and other components supported by the module 40. In some embodiments, the support members 74 can be used to provide a widely disbursed support surface for one or more of the components. Further, the components can be mounted and secured to the support members 72, 74, or other supporting surfaces by one or more hold down members 82 that can be coupled to the other support members by one or more couplers 84. In general, the couplers 84 will be adjustable to change an amount of compression, tension, or both on the components to change a natural frequency of the components, frame, or system. The change can reduce reactive vibrations that are magnified when the vibrations occur as a natural frequency.

It is to be understood that the exemplary structural elements of the module 40 with its frame 70, are intended for illustrative only and not intended to be limiting as to the size, shape, style, quantity, position, or other aspects as may be appropriate for a given application mounting particular components at various heights and positions.

Other and further embodiments utilizing one or more aspects of the invention described above can be devised without departing from the spirit of the invention. For example, the number of outlets or inlets can vary on the collection block from one to many, the shape of the collection block can vary, and the direction and orientation of the inlets and outlets can vary. Other variations in the system are possible.

Further, the various methods and embodiments of the system can be included in combination with each other to produce variations of the disclosed methods and embodiments. Discussion of singular elements can include plural elements and vice-versa. References to at least one item followed by a reference to the item may include one or more items. Also, various aspects of the embodiments could be used in conjunction with each other to accomplish the understood goals of the disclosure. Unless the context requires otherwise, the word "comprise" or variations such as "comprises" or "comprising," should be understood to imply the inclusion of at least the stated element or step or group of elements or steps or equivalents thereof, and not the exclusion of a greater numerical quantity or any other element or step or group of elements or steps or equivalents thereof. The device or system may be used in a number of directions and orientations. The term "coupled," "coupling," "coupler," and like terms are used broadly herein and may include any method or device for securing, binding, bonding, fastening, attaching, joining, inserting therein, forming thereon or therein, communicating, or otherwise associating, for example, mechanically, magnetically, electrically, chemically, operably, directly or indirectly with intermediate elements, one or more pieces of members together and may further include without limitation integrally forming one functional member with another in a unity fashion. The coupling may occur in any direction, including rotationally.

The order of steps can occur in a variety of sequences unless otherwise specifically limited. The various steps described herein can be combined with other steps, interlineated with the stated steps, and/or split into multiple steps. Similarly, elements have been described functionally and can be embodied as separate components or can be combined into components having multiple functions.

The inventions have been described in the context of preferred and other embodiments and not every embodiment of the invention has been described. Obvious modifications and alterations to the described embodiments are available to those of ordinary skill in the art. The disclosed and undisclosed embodiments are not intended to limit or restrict the scope or applicability of the invention conceived of by the Applicant, but rather, in conformity with the patent laws, Applicant intends to protect fully all such modifications and improvements that come within the scope or range of equivalent of the following claims.

What is claimed is:

1. An oil field manifold system for flowing fluids having particles entrained therein, comprising:

a manifold comprised of one or more manifold portions for flowing fluids therethrough, the manifold having a beginning with a supply inlet and an end different from the beginning;

one or more valves, fluid fittings, or a combination thereof fluidicly coupled to the manifold portions;

the manifold having bores at the beginning and end of the manifold with the bore at the end of the manifold being a same size as the bore at the beginning; and wherein the one or more valves, fluid fittings, or a combination thereof have a bore the same size as the bores at the beginning and end of the manifold and include a valve coupled to the end of the manifold and configured to selectively close off fluid flow beyond the end of the manifold, the valve coupled to the end of the manifold having a bore the same size as the bore at the end of the manifold.

2. The system of claim 1, further comprising at least two valves coupled to the end of the manifold.

3. The system of claim 1, further comprising an end module having one or more manifold portions fluidicly coupled to the end of the manifold and one or more valves coupled to the one or more end module manifold portions, the one or more valves of the end module having a bore the same size as the bore at the end of the manifold thereby being configured to drain a full bore of the manifold.

4. The system of claim 1, further comprising a plurality of supply inlets fluidicly coupled between the beginning and end of the manifold.

5. The system of claim 1, wherein the one or more manifold portions are coupled to a support frame.

6. An oil field manifold system for flowing fluids having particles entrained therein, comprising:

a first module disposed at a beginning of a manifold, comprising a support frame;

one or more manifold portions coupled to the frame, the manifold portions having a bore for flowing fluids therethrough; and one or more valves, fluid fittings, or a combination thereof coupled to the manifold portions and having a bore that is a same size as the bore of the one or more manifold portions; and an end module disposed at an end of the manifold different from the beginning, comprising a frame;

one or more manifold portions coupled to the frame, the manifold portions having a bore for flowing fluids therethrough; and one or more valves, fluid fittings, or a combination thereof coupled to the manifold portions and having a bore that is a same size as the bore of the one or more manifold portions;

the bore of the one or more manifold portions coupled to the end module being of a same size as the bore of the one or more manifold portions coupled to the first module.

7. The system of claim 6, further comprising a valve coupled to the end of the manifold, the valve's bore being the same size as the bore of the one or more manifold portions coupled to the frame of the end module.

8. The system of claim 7, further comprising at least two valves coupled to the end of the manifold.

9. The system of claim 6, wherein the first module is a supply module including a supply inlet, and further comprising a transition module comprising one or more transition manifold portions fluidicly coupled between the one or more manifold portions of the end module and the one or more manifold portions of the first module.

10. The system of claim 6, wherein at least one of the first module and the end module further comprises a plurality of frames each having at least one manifold portion coupled thereto.

11. An oil field manifold system for flowing fluids having particles entrained therein, comprising:

a first module, comprising a first support frame including a plurality of support members coupled to a base;

a first manifold portion configured for fluid flow therethrough and coupled to the first support frame above the base thereof, the first manifold portion having an inlet, an outlet and a first bore;

a second module, comprising a second support frame including a plurality of support members coupled to a base;

a second manifold portion configured for fluid flow therethrough and coupled to the second support frame above the base thereof, the second manifold portion having an inlet, an outlet and a second bore; and a fluid line having a fluid line bore;

wherein the first bore, second bore and fluid line bore are of a same size; and wherein the fluid line is fluidicly coupled between the outlet of the first manifold portion and the inlet of the second manifold portion thereby forming at least a portion of a first manifold having a uniform bore.

12. The system of claim 11, further comprising at least one flow component fluidicly coupled to one of the first and second manifold portions, the at least one flow component having a bore that is the same size as the uniform bore and being selected from the group consisting of a valve, a fluid fitting, a valve group, and a combination thereof.

13. The system of claim 11, further comprising a third module including a third manifold portion having a bore that is the same size as the uniform bore, wherein the third manifold portion is fluidicly coupled either upstream from the inlet of the first manifold portion or downstream from the outlet of the second manifold portion.

14. The system of claim 11, further comprising:

a third manifold portion coupled to the first support frame;

a fourth manifold portion coupled to the second support frame; and a second fluid line;

wherein the third manifold portion, fourth manifold portion and second fluid line have bores of a same size; and wherein the second fluid line is fluidicly coupled between the third manifold portion and the fourth manifold portion thereby forming at least a portion of a second manifold having a uniform bore.

15. The system of claim 14, wherein the uniform bores of the first and second manifolds are sized the same.

16. The system of claim 14, wherein the uniform bores of the first and second manifolds are sized differently.

17. The system of claim 11, further comprising a third manifold portion coupled to at least one of the first and second support frames, the third manifold portion having an outlet and a plurality of supply inlets.

18. An oil field manifold system for flowing fluids having particles entrained therein, comprising:

a manifold comprised of one or more manifold portions for flowing fluids therethrough, the manifold having a beginning with a supply inlet and an end different from the beginning;

one or more valves, fluid fittings, or a combination thereof fluidicly coupled to the manifold portions;

the manifold having bores at the beginning and end of the manifold with the bore at the end of the manifold being a same size as the bore at the beginning;

wherein the one or more valves, fluid fittings, or a combination thereof have a bore the same size as the bores at the beginning and end of the manifold; and wherein each of the one or more manifold portions is coupled to a separate support frame.

* * * * *